United States Patent [19]

Van Helden et al.

[11] Patent Number: 4,994,171

[45] Date of Patent: Feb. 19, 1991

[54] PROCESS FOR THE MANUFACTURE—GAS OILS

[75] Inventors: Henricus J. A. Van Helden; Niels Fabricius; Woutherus M. M. Dekkers, all of The Hague, Netherlands

[73] Assignee: Shell Internationale Research Maatschappij B.V., The Hague, Netherlands

[21] Appl. No.: 364,492

[22] Filed: Jun. 9, 1989

Related U.S. Application Data

[63] Continuation of Ser. No. 123,513, Nov. 20, 1987, abandoned.

[30] Foreign Application Priority Data

Dec. 10, 1986 [GB] United Kingdom ..... 8629477

[51] Int. Cl.[5] ..... C10G 35/06

[52] U.S. Cl. ..... 208/67; 208/58; 208/143

[58] Field of Search ..... 208/143, 58, 67

[56] References Cited

U.S. PATENT DOCUMENTS

| | | | |
|---|---|---|---|
| 3,172,833 | 3/1965 | Kozlowski et al. | 208/58 |
| 3,592,757 | 7/1971 | Baral | 208/58 |
| 3,655,551 | 4/1972 | Hass et al. | 208/58 |
| 3,751,360 | 8/1973 | Bernstein et al. | 208/58 |
| 3,954,601 | 5/1976 | Cosyns et al. | 208/143 |
| 4,213,847 | 7/1980 | Chen et al. | 208/166 |
| 4,592,828 | 6/1986 | Chu et al. | 208/213 |

FOREIGN PATENT DOCUMENTS

| | | | |
|---|---|---|---|
| 1270607 | 4/1972 | United Kingdom | 208/58 |

*Primary Examiner*—Curtis R. Davis

*Attorney, Agent, or Firm*—Jones, Tullar & Cooper

[57] ABSTRACT

Process for the manufacture of kerosene and/or gas oil(s) wherein a hydrocarbon feedstock is catalytically treated in the presence of hydrogen at elevated temperature and pressure and wherein the material obtained is subjected to a distillation treatment, in which process a hydrocarbon feedstock is used containing flashed distillate produced via a catalytic residue conversion process.

27 Claims, 2 Drawing Sheets

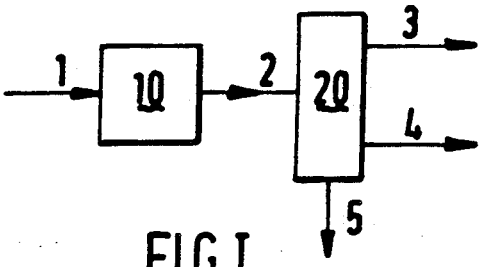
FIG. I
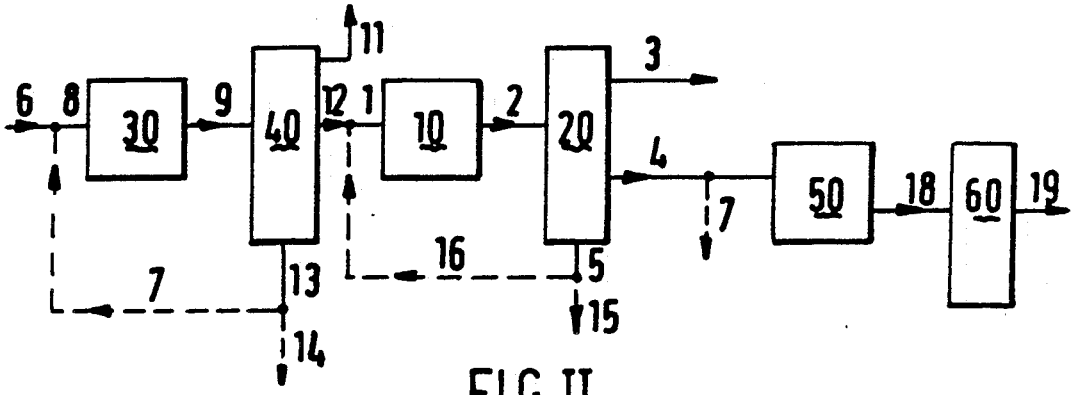
FIG. II
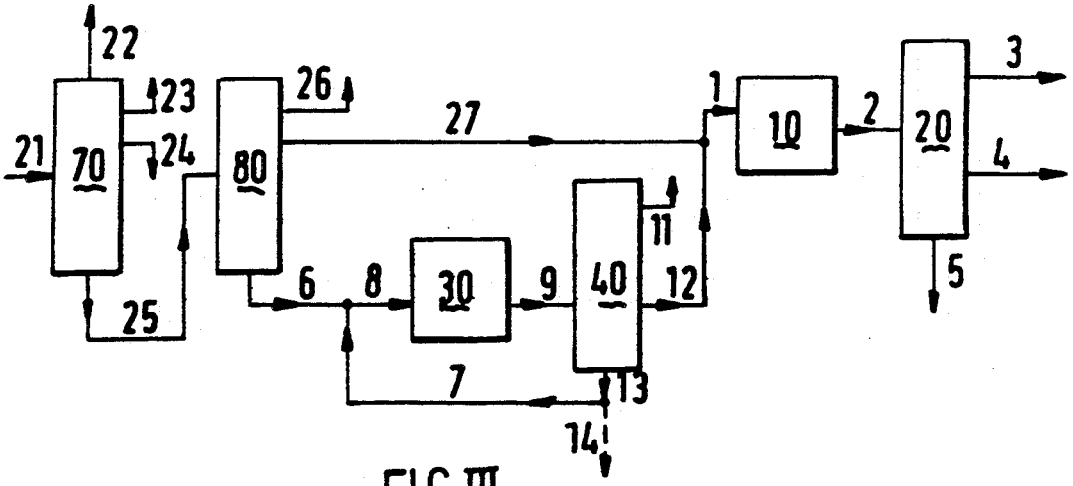
FIG. III

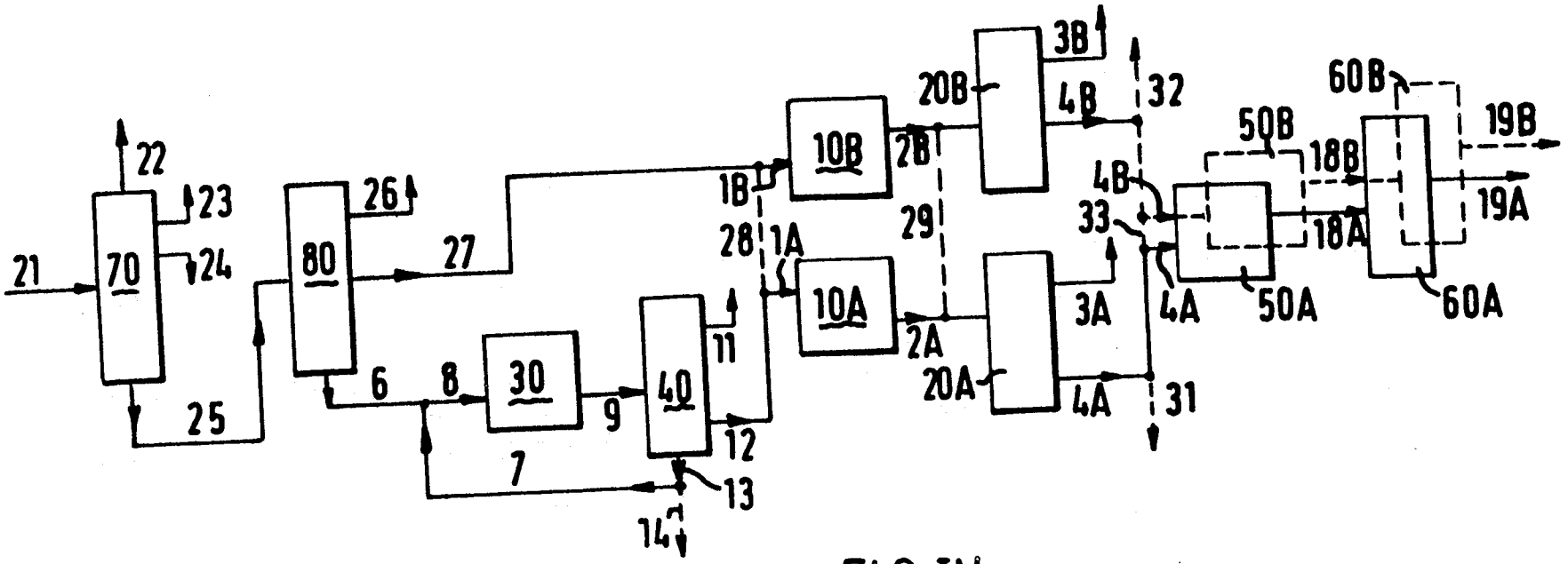
FIG. IV

PROCESS FOR THE MANUFACTURE—GAS OILS

This is a continuation of co-pending application Ser. No. 07/123,513 filed on Nov. 20, 1987, and now abandoned.

The present invention relates to an improved process for the manufacture of kerosene and/or gas oils and to kerosene and gas oils thus prepared.

Petroleum products such as kerosene and gas oils can be prepared from crude oils or (semi)-synthetic feedstocks by a great variety of processes which range from physical processes such as solvent deasphalting and thermal treatments such as thermal cracking and visbreaking to catalytic treatments such as catalytic cracking, hydrotreatment and hydrocracking to mention a few.

It has now become common practice to produce petroleum products from crude oil using a combination of two or more of the above-mentioned techniques depending on the nature of the feedstock to be treated and the product or product slate to be produced.

For instance, the production of petroleum fractions such as deasphalted oils and/or distillates by a combination of solvent deasphalting, hydrotreatment and thermal cracking has been extensively described, inter alia, in the following European patent specifications: Nos. 82,551; 82,555; 89,707; 90,437 and 90,441. Processes which comprise a two-stage solvent deasphalting treatment in combination with one or more of the above-mentioned treatments have been disclosed in European patent specifications Nos. 99,141 and 125,709.

Although good quality products can be obtained in fair yields using solvent-deasphalting it has the intrinsic disadvantage that it is operated at various temperature and pressure cycles which make this treatment rather cumbersome and energy-consuming, in particular in view of the huge amounts of solvents involved. This treatment is therefore difficult to integrate in an approach directed at maximum flexibility at minimal changes in temperature and pressure levels.

It has now been found that heavy materials originating from vacuum residues which have been subjected to a certain residue conversion process can be used as feedstocks in the manufacture of kerosene and/or gas oils. The use of such materials allows a substantial improvement in the amounts of kerosene and gas oils to be produced from a given amount of crude oil.

The present invention thus relates to a process of the manufacture of kerosene and/or gas oil(s) wherein a hydrocarbon feedstock is catalytically treated in the presence of hydrogen at elevated temperature and pressure and wherein the material obtained is subjected to a distillation treatment, in which process a hydrocarbon feedstock is used containing flashed distillate produced via a catalytic residue conversion process.

By using a flashed distillate derived from a catalytically converted vacuum residue in the manufacture of kerosene and gas oils, low quality materials are transformed into high value products which intrinsically enlarges the flexibility of the refinery operation.

It is possible to use a feedstock oontaining besides flashed distillate derived from a converted vacuum residue also a substantial amount of a flashed distillate which has not been subjected to a conversion process, e.g. a flashed distillate normally obtained in a vacuum distillation process. It is also possible to use flashed distillate normally obtained in an atmospheric distillation process or to use mixtures containing both flashed distillate obtained in an atmospheric distillation process and flashed distillate obtained in a vacuum distillation process as part of the feed to the catalytic hydrotreatment. The amount of vacuum residue derived flashed distillate preferably ranges between 10 and 60% by volume of the total flashed distillate used as feed for the catalytic hydrotreatment.

The feedstock to be used in the process according to the present invention is based on a flashed distillate produced via a residue conversion process, i.e. the feedstock contains a distillation product having a boiling range between 320 ° C. and 600 ° C., in particular between 350 ° C. and 520 ° C. which has been obtained by subjecting part or all of the effluent from a residue conversion process to a distillation treatment, in particular a distillation treatment under reduced pressure. The feedstock for the residue conversion process is suitably obtained by subjecting an atmospheric residue to distillation under reduced pressure to produce a flashed distillate (which may be co-processed in the process according to the present invention) and a vacuum residue which serves as feedstock for said residue conversion process.

The catalytic residue conversion process operative to produce flashed distillate to be used as feedstock in the manufacture of kerosene and/or gas oils in accordance with the present invention preferably comprises a catalytic conversion process such as a hydroconversion process wherein at least 10% w of the feedstock is converted to lower boiling material.

The catalytic residue conversion processes, which may be carried out in combination with one or more pretreatments to substantially reduce the amount of heavy metals, in particular nickel and vanadium, present in asphaltenes-containing vacuum residues, and/or the amount of sulphur and to a lower extent nitrogen in vacuum residues, are normally carried out in the presence of hydrogen using an appropriate supported catalyst at a temperature of from 300 ° C. to 500 ° C., in particular of from 350 ° C. to 450 ° C., a pressure of from 50 to 300 bar, in particular of from 75 to 200 bar, a space velocity of from 0.02–10 kg. $kg^{-1}$. $kg^{-1}$., in particular of from 0.1–2 kg. $kg^{-1}$. $h^{-1}$ and a hydrogen/feed ratio of from 100-5000 Nl/$kg^{-1}$, in particular of from 500-2000 Nl/$kg^{-1}$.

Suitable catalysts for carrying out such hydroconversion process are those containing at least one metal chosen from the group formed by nickel and cobalt and in addition at least one metal chosen from the group formed by molybdenum and tungsten on a carrier, preferably a carrier containing a substantial amount of alumina, e.g. at least 40% w. The amounts of the appropriate metals to be used in the hydroconversion process may vary between wide ranges and are well-known to those skilled in the art.

It should be noted that asphaltenes-oontaining hydrocarbon residues having a nickel and vanadium content of more than 50 ppmw are prefarably subjected to a demetallization treatment. Such treatment is suitably carried out in the presence of hydrogen using a catalyst containing a substantial amount of silica, e.g. at least 80 % w. If desired, one or more metals or metal compounds having hydrogenating activity such as nickel and/or vanadium may be present in the demetallization catalyst. Since the catalytic demetallization and the hydroconversion process may be carried out under the same conditions, the two processes may very suitably be carried out in the same reactor containing one or more beds of demetallization catalyst on top of one or more beds of hydroconversion catalyst.

Flashed distillate obtained via a catalytic residue conversion process is subjected, preferably together with flashed distillate originating from a distillation treatment under reduced pressure of an atmospheric residue which has not been subjected to a catalytic residue conversion process, to a catalytic treatment in the presence of hydrogen. The catalytic treatment in the presence of hydrogen can be carried out under a variety of process conditions. The severity of the treatment, ranging from predominantly hydrogenation to predominantly hydrocracking will depend on the nature of the flashed distillate(s) to be processed and the type(s) of products to be manufactured. Preferably, the catalytic treatment in the presence of hydrogen is carried out under such conditions as to favour hydrocracking of the flashed distillate(s).

Suitable hydrocracking process conditions to be applied comprise temperatures in the range of from 250 ° C. to 500 ° C., pressures up to 300 bar and space velocities between 0.1 and 10 kg feed per liter of catalyst per hour. Gas/feed ratios between 100 and 5000 Nl/kg feed can suitably be used. Preferably, the hydrocracking treatment is carried out at a temperature between 300 ° C. and 450 ° C., a pressure between 25 and 200 bar and a space velocity between 0.2 and 5 kg feed per liter of catalyst per hour. Preferably, gas/feed ratios between 250 and 2000 are applied.

Well-established amorphous hydrocracking catalysts can be suitably applied as well as zeolite-based hydrocracking catalysts which may have been adapted by techniques like ammonium ion exchange and various forms of calcination in order to improve the performance of the hydrocracking catalysts based on such zeolites.

Zeolites particularly suitable as starting materials for the manufacture of hydrocracking catalysts comprise the well-known synthetic zeolite Y and its more recent modifications such as the various forms of ultra-stable zeolite Y. Preference is given to the use of modified Y-based hydrocracking catalysts wherein the zeolite used has a pore volume which is made up to a substantial amount of pores having a diameter of at least 8 nm. The zeolitic hydrocracking catalysts may also contain other active components such as silica-alumina as well as binder materials such as alumina.

The hydrocracking catalysts contain at least one hydrogenation component of a Group VI metal and/or at least one hydrogenation component of a Group VIII metal. Suitably, the catalyst compositions comprise one or more components of nickel and/or cobalt and one or more components of molybdenum and/or tungsten or one or more components of platinum and/or palladium. The amount(s) of hydrogenation component(s) in the catalyst composition suitably range between 0.05 and 10% w of Group VIII xetal component(s) and between 2 and 40% w of Group VI xetal component(s), calculated as metal(s) per 100 parts by weight of total catalyst. The hydrogenation components in the catalyst compositions may be in the oxidic and/or the sulphidic form. If a combination of at least a Group VI and a Group VIII metal component is present as (mixed) oxides, it will be subjected to a sulphiding treatment prior to proper use in hydrocracking.

If desired, a single hydrocracking reactor can be used in the process according to the present invention, wherein also flashed distillate obtained via vacuum distillation of an atmospheric residue which has not been subjected to a residue conversion process can be co-processed. It is also possible to process a feedstock containing a flashed distillate produced via a residue conversion process in parallel with a feedstock containing a flashed distillate obtained via vacuum distillation of an atmospheric residue in a second hydrocracker. The hydrocrackers may be operated at the same or different process conditions and the effluents may be combined prior to further treatment.

At least part of the gas oil obtained in the hydrocatalytic treatment may be subjected to a dewaxing treatment in order to improve its properties, in particular its pour point. Both solvent dewaxing and catalytic dewaxing can be suitably applied.

It is also possible to subject some of the hydrocatalytically treated effluent to solvent dewaxing and some, in particular higher boiling effluent to catalytic dewaxing.

It will be appreciated that preference will be given from an integrated process point of view to a catalytic dewaxing treatment in view of the huge energy costs involved in solvent dewaxing due to heating, cooling and transporting large amounts of solvents. Catalytic dewaxing is suitably carried out by contacting part or all of the effluent from the hydrocatalytic treatment in the present of hydrogen with an appropriate catalyst. Suitable catalysts comprise crystalline aluminium silicates such as ZSM-5 and related compounds, e.g. ZSM-8, ZSM-11, ZSM-23 and ZSM-35 as well as ferrierite type compounds. Good results can also be obtained using composite crystalline aluminium silicates wherein various crystalline structures appear to be present. Normally, the catalytic dewaxing catalysts will comprise metal compounds such as Group VI and/or Group VIII compounds.

The catalytic hydrodewaxing may very suitably be carried out at a temperature of from 250 ° C. to 500 ° C., a hydrogen pressure of from 5-200 bar, a space velocity of from 0.1–5 kg per liter per hour and a hydrogen/feed ratio of from 100–2500 Nl/kg of feed. Preferably, the catalytic hydrodewaxing is carried out at a temperature of from 275 ° C. to 450 ° C., a hydrogen pressure of from 10–110 bar, a space velocity of from 0.2–3 kg per liter per hour and a hydrogen/feed ratio of from 200–2,000 Nl per kg of feed.

The catalytic dewaxing can be carried out in one or more catalytic dewaxing units which xay operate under the same or under different conditions.

It may be advantageous with respect to further improving product quality to subject the effluent from the catalytic dewaxing treatment to a further hydrotreatment. This further hydrotreatment is suitably carried out at a temperature between 250 ° C. and 375 ° C. and a pressure between 45 and 250 bar, to primarily hydrogenate unsaturated components present in the dewaxed material. Catalysts suitably applied in the further hydrotreatment include Group VIII metals, in particular Group VIII noble metals, on a suitable support such as silica, alumina or silica-alumina. A preferred catalyst system comprises platinum on silica-alumina.

The process according to the present invention is in particular advantageous in that it allows an integrated approach to the production of kerosene and gas oils in high yields directly from an atmospheric residue which serves not only as the source for the feedstock to be used, i.e. flashed distillate obtained via a residue conversion process using the vacuum residue as feedstock, but also as the source for any additional flashed distillate (not obtained via a residue conversion process) to be co-processed.

It should be noted that the severity of the catalytic hydrotreatment employed will govern the ratio of kerosene and gas oil produced.

When the catalytic hydrotreatment is carried out under relatively mild conditions gas oils will be predominantly produced together with a small amount of kerosene. When the severity of the hydrotreatment is increased a further reduction in boiling point range will be observed indicating that kerosene is the main product with virtually no gas oil production. Small amounts of naphtha may be co-produced under the prevailing hydrotreatment conditions.

It may be advantageous to recycle at least part of the bottom fraction of the distillation unit to the catalytic hydrotreatment unit to increase the level of conversion. It is also possible to recycle part of the gas oil produced to the catalytic hydrotreatment unit. This will cause production of relatively light gas oils which need not be subjected to a (catalytic) dewaxing treatment or, if desired, only to a very mild (catalytic) dewaxing treatment.

A further possibility to upgrade the bottom fraction of the distillation unit after the catalytic hydrotreatment comprises the use of said bottom fraction optionally together with a heavy part of the distillate obtained as feedstock, optionally together with other heavy components, for an ethylene cracker wherein said feedstock is converted in the presence of steam into ethylene which is a very valuable feedstock for the chemical industry. The methods to operate an ethylene cracker are known to those skilled in the art.

The flexibility of the process according to the present invention can be increased even further when the effluent from the catalytic hydrotreatment is subjected to distillation in such a way that two gas oil fractions are obtained: a light gas oil and a heavy gas oil, at least part of which being recycled to the catalytic hydrotreatment stage to improve product quality.

The present invention will now be illustrated by means of FIGS. 1–4. In FIG. 1 a process is depicted for the production of kerosene and gas oils by catalytic hydrotreatment of a flashed distillate obtained via a catalytic residue conversion process and distillation of the product thus obtained.

In FIG. 2 a process is depicted wherein use is made of a catalytic residue conversion unit to produce the feed for the catalytic hydrotreatment and wherein part of the gas oil produced is subjected to catalytic dewaxing followed by hydrotreatment of the dewaxed material obtained.

In FIG. 3 a further process embodiment is depicted for the production of kerosene and/or gas oil starting from a vacuum residue.

In FIG. 4 an integrated process scheme is depicted for the production of kerosene and/or gas oil starting from crude oil. In this process two catalytic hydrotreatments and two catalytic dewaxing units can be employed.

Preferably, the process according to the present invention is carried out by subjecting a crude oil to an atmospheric distillation to produce one or more atmospheric distillates suitable for the production of kerosene and/or gas oil(s) and an atmospheric residue which is subjected to distillation under reduced pressure to produce a light distillate suitable for the production of gas oil(s), a flashed distillate which may be subjected to a catalytic (cracking) treatment in the presence of hydrogen and a vacuum residue which is used at least partly as feedstock in a catalytic residue conversion process to produce one or more gas oils (if desired) and a flashed distillate to be subjected to a catalytic (cracking) treatment in the presence of hydrogen whilst part or all of the bottom fraction may be recycled to the residue conversion unit and wherein catalytically treated material is subjected to a distillation treatment to obtain kerosene and one or more gas oils.

Preferably, at least part of the gas oil obtained may be subjected to a dewaxing treatment. When the process according to the present invention is carried out under such conditions that a light and a heavy gas oil are produced at least part of the heavy gas oil is subjected to catalytic dewaxing. Part of the gas oil produced may also be recycled to the catalytic treatment unit.

It is further preferred to subject flashed distillate obtained by distillation under reduced pressure and flashed distillate obtained via a catalytic residue conversion process to a catalytic cracking treatment in the presence of hydrogen in the same reactor. Preferably, flashed distillate obtained by distillation under reduced pressure and flashed distillate obtained by catalytic residue conversion are catalytically cracked in the presence of hydrogen in parallel reactors which may operate under different conditions and wherein the effluents obtained are subjected to separate distillation treatments. Part of the gas oils obtained in the separate distillation treatments may be subjected to catalytic dewaxing and hydrotreatxent in the same or different dewaxing and hydrotreating units.

In FIG. 1 a process is depicted comprising a hydrocracking unit 10 and a distillation unit 20. A flashed distillate produced via a catalytic residue conversion process is fed via line 1 into the hydrocracking unit 10. The effluent from the hydrocracking unit 10, which may be subjected to a treatment to remove gaseous materials is introduced via line 2 into the distillation unit 20. From the distillation unit 20 kerosene is obtained via line 3 and gas oil via line 4. The bottom fraction of the distillation unit 20 can be withdrawn via line 5 to serve for other purposes, e.g., as fuel, as recycle to the catalytic hydrotreatment or as feed for the production of lubricating base oils.

In FIG. 2 a process is depicted comprising a hydrocracking unit 10, a distillation unit 20, a catalytic residue conversion unit 30, a distillation unit 40, a catalytic dewaxing unit 50 and a hydrotreatment unit 60. A vacuum residue is introduced via line 6, optionally after having been mixed with a recycled distillation residue via lines 13 and 7 as described hereinafter, and line 8 into residue conversion unit 30. The effluent from the residue conversion unit, which may be subjected to a treatment to remove gaseous materials, is subjected via line 9 to distillation unit 40 to produce a gas oil fraction (if desired) via line 11, a flashed distillate which is sent to the hydrocracking unit 10 via line 12 and a distillation residue 13 which can be partly recycled to the residue conversion unit via line 7 and which can be used for other purposes via line 14. The flashed distillate produced via residue conversion unit 30 is introduced via line 1, optionally after having been mixed with a recycled distillation residue via lines 5 and 16, into hydrocracking unit 10.

The effluent from hydrocracking unit 10, which may be subjected to a treatment to remove gaseous materials, is introduced via line 2 into distillation unit 20 to produce a kerosene fraction via line 3, a gas oil fraction via line 4 and a distillation residue via line 5 which may be partly recycled to the hydrocracking unit 10 via line 16 and which can be used for other purposes via line 15. The gas oil obtained via line 4 is sent to catalytic dewaxing unit 50 whereas part of the gas oil may be withdrawn prior to the catalytic dewaxing treatment via line 17. The effluent from the catalytic dewaxing unit 50, which may be subjected to a treatment to remove gaseous materials, is subjected via line 18 to hydrotreatment in a hydrotreatment unit 60. The final product is obtained via line 19.

In FIG. 3 a process is depicted comprising a hydrocracking unit 10, a distillation unit 20, a catalytic residue conversion unit 30, a distillation unit 40, an atmospheric distillation unit 70 and a vacuum distillation unit 80. A crude oil is introduced via line 21 into atmospheric distillation unit 70 from which are obtained gaseous material via line 22, a kerosene fraction via line 23, a gas oil fraction via line 24 and an atmospheric residue which is sent via line 25 to vacuum distillation unit 80 from which are obtained a further gas oil fraction via line 26, a flashed distillate fraction via line 27 which is subjected to hydrocracking to be described hereinafter and a vacuum residue via line 6. The vacuum residue in line 6 is combined with recycled distillation residue via line 7 and sent via line 8 to residue conversion unit 30. If desired a part of the feed to the residue conversion unit (either before or after mixing with recycled material) may be withdrawn from the system (not shown). The effluent from the residue conversion unit 30, which may be subjected to a treatment to remove gaseous materials, is subjected via line 9 to distillation in distillation unit 40 to produce, if desired, a third gas oil fraction via line 11, a flashed distillate to be subjected to hydrocracking via line 12 and a distillation residue 13 which is partly or totally recycled to residue conversion unit 30. Removal of part of this distillation residue can be achieved via line 14. The flashed distillate via line 27 and the flashed distillate via line 12 are combined and sent via line 1 to the hydrocracking unit 10. The sequence of the process as described for FIG. 1 leads to the production of kerosene and gas oil.

In FIG. 4 a process is depicted comprising two hydrocrackers 10A and 10B, two distillation units 20A and 20B, a residue conversion unit 30, a distillation unit 40, two catalytic dewaxing units 50A and 50B (which unit is optional in the process as depicted in this FIG.), two hydrotreatment units 60A and 60B (which unit is optional in the process as depicted in this FIG.), an atmospheric distillation unit 70 and a vacuum distillation unit 80. The preparation of the feedstock for the residue conversion units 10A and 10B is carried out as depicted in FIG. 3.

Flashed distillate obtained via the catalytic residue conversion process is introduced via line 1A into hydrocracker 10A and flashed distillate obtained via vacuum distillation is introduced via line 1B into hydrocracker 10B. Line 28 may be used to transport flashed distillate via lines 12, 28 and 1B to hydrocracker 10B or to transport flashed distillate via lines 27, 28 and 1A to hydrocracker 10A. The effluent from hydrocracker 10A, which may be subjected to a treatment to remove gaseous materials, is sent via line 2A to distillation unit 20A. The effluent from hydrocracker 10B, which may be subjected to a treatment to remove gaseous materials, is sent via line 2B to distillation unit 20B. If desired part of the effluent from hydrocracker 10A may be sent to distillation unit 20B via lines 2A, 29 and 2B and part of the effluent from hydrocracker 10B may be sent to distillation unit 10A via lines 2B, 29 and 2A. From distillation unit 20A a further kerosene fraction is obtained via line 3A and a further gas oil fraction via line 4A. From distillation unit 20B a further kerosene fraction is obtained via line 3B and a further gas oil fraction via line 4B. When the process as depicted in FIG. 4 is carried out using two catalytic dewaxing units 50A and 50B, gas oil obtained from distillation unit 10A is sent via line 4A to catalytic dewaxing unit 50A. Part of this gas oil xay be withdrawn prior to the catalytic dewaxing via line 31. Gas oil obtained from distillation unit 20B is sent to catalytic dewaxing unit 50B via line 4B. Part of this gas oil may be withdrawn prior to the catalytic dewaxing via line 32. If desired part of the gas oil obtained from distillation unit 20A may be sent via lines 4A, 33 and 4B to catalytic dewaxing unit 50B and part of the gas oil obtained in distillation unit 20B may be sent to catalytic dewaxing unit 50A via lines 4B, 33 and 4A. By proper use of the transfer lines 28, 29 and 33 the flexibility of the prooess according to the present invention is substantially increased, ranging from single train to complete parallel train operation. The effluents from the catalytic dewaxing units 50A and 50B are sent via lines 18A and 18B (which may be connected by a transfer line) to hydrotreatment units 60A and 60B to produce the desired products via lines 19A and 19B. It will be clear that the single and parallel train approach can be extended so as to encompass also the catalytic dewaxing stage and/or the hydrotreatment stage.

The present invention will now be illustrated by means of the following Examples.

EXAMPLE I - Conversion of synthetic flashed distillate into kerosene and gas oil An atmospheric residue of Middle East origin was converted into kerosene and gas oil using in essence, the following process line up wherein the numbers of lines and units to be referred to hereinbelow have the same meaning as given in the description of FIG. 3. It should be noted that the embodiment according to this Example is carried out by introducing the feedstock directly via line 25 into vacuum distillation unit 80; by not subjecting distillate 27 to any further process and by not recycling distillation residue to catalytic residue conversion unit 30. Thus, atmospheric residue of Middle East origin (100 parts by weight - pbw-) was sent via line 25 to vacuum distillation unit 80 to produce 40.5 pbw flashed distillate and 59.5 pbw vacuum residue. Said vacuum residue was sent via lines 6 and 8 to catalytic residue conversion unit 30. The catalytic residue conversion unit was operated at 435 ° C. and a hydrogen partial pressure of 150 bar using a molybdenum on silica conversion catalyst. The conversion was carried out at a space velocity of 0.30 kg/kg.1 and 2.4 pbw of hydrogen were used during the catalyst conversion stage.

The effluent from the catalytic residue conversion unit 30 was sent via line 9 to the distillation unit 40 which contains an atmospheric distillation stage and a vacuum distillation stage to produce 3.5 pbw of hydrogen sulphide and ammonia, 5.3 pbw of products boiling below the boiling range of naphtha (referred to as naphtha-minus), 5.5 pbw of naphtha, 12.3 pbw of kerosene, 16.7 pbw of gas oil (obtained via line 11), 6 pbw of a vacuum residue (removed via line 13) and 12.6 pbw of a synthetic flashed distillate to be sent as feedstock for the catalytic hydrotreatment in catalytic hydrotreatment unit 10 via lines 12 and 1. The properties of the synthetic flashed distillate to be used as feedstock in the catalytic hydrotreatment unit 10 and produced via catalytic residue conversion unit 30 are: density (15.4): 0.93; hydrogen content: 11.9% wt; sulphur content: 0.6% wt;, nitrogen content: 0.21% wt; Conradson Carbon Residue: <0.5% wt and mid boiling point of the feedstock: 445 ° C.

The material was subjected to a catalytic hydrotreatment in unit 10 using a catalyst based on nickel/tungsten on alumina. The catalytic hydrotreatment was carried out at a temperature of 405° C., a hydrogen partial pressure of 130 bar and a space velocity of 0.84 kg/kg.h. 0.4 pbw of hydrogen was used during the treatment. The effluent from the catalytic hydrotreatment unit 10 was sent via line 2 to atmospheric distillation unit 20 to produce 0.1 pbw of hydrogen sulphide and amonia, 0.6 pbw of naphtha-minus, 2.7 pbw of naphtha and 5:1 pbw of kerosene (via line 3) and 4.5 pbw of gas oil (via line 4).

When an experiment was carried out using 100 pbw of an atmospheric residue of Middle East origin directly as feedstock for the catalytic residue conversion unit 30 under otherwise similar conditions (3.2 pbw of hydrogen being used during the residue conversion stage) 26.7 pbw of synthetic flashed distillate was obtained which yielded after the catalytic hydrotreatment stage (wherein 0.7 pbw of hydrogen was used) 0.2 pbw of hydrogen sulphide and ammonia, 1.3 pbw of naphtha-minus, 5.7 pbw of naphtha, 10.8 pbw of kerosene and 9.4 pbw of gas oil.

EXAMPLE II - Conversion of flashed distillate and synthetic flashed distillate into kerosene and gas oil The experiment as described in Example 1 was repeated using the same units as described in Example I but now allowing the flashed distillate obtained by vacuum distillation unit 80 to join the synthetic flashed distillate obtained via line 12 to serve as a combined feedstock (via line 1) for catalytic hydrotreatment unit 10. Thus, an atmospheric residue of Middle East origin (100 pbw) was sent via line 25 to vacuum distillation unit 80 to produce 40.5 pbw flashed distillate and 59.5 pbw vacuum residue. The vacuum residue obtained was processed as described in Example I (2.4 pbw of hydrogen being used) to yield 12.6 pbw of a synthetic flashed distillate (together with the products as described in Exaxple I). Said synthetic flashed distillate was sent via lines 12 and 1, after combination with the flashed distillate obtained by vacuum distillation transported through line 27, to catalytic hydrotreatment unit 10. The properties of the combined flashed distillates feedstock to be used for the catalytic hydrotreatment unit 10 are: density (15/4): 0.93; hydrogen content: 12.2% wt; sulphur content: 2.4% wt; nitrogen content: 0.09% wt; Conradson Carbon Residue: <0.5% wt and mid boiling point of the feedstock: 445 ° C.

The material was subjected to a catalytic hydrotreatment in unit 10 under the conditions as described in Example I. 1.5 pbw of hydrogen were used during the treatment. The effluent from the catalytic hydroconversion unit 10 was sent via line 2 to atmospheric distillation unit 20 to produce 1.4 pbw of hydrogen sulphide and ammonia, 2.6 pbw of naphtha-minus, 11.1 pbw of naphtha and 21.1 pbw of kerosene (via line 3) and 18.4 pbw of gas oil (via line 4).

EXAMPLE III - Conversion of (synthetic) flashed distillates in recycle operation The experiment as described in the previous Example was repeated but now allowing part of the vacuum residue obtained via line 13 to be recycled to catalytic residue conversion unit 30 via line 7. Thus, an atmospheric residue of Middle East origin (100 pbw) was sent via line 25 to vacuum distillation unit 80 to produce line 7. Thus, an atmospheric residue of Midd1=East origin (100 40.5 pbw of flashed distillate to be sent via lines 27 and 1 to catalytic hydrotreatment unit 10 and 59.5 pbw of vacuum residue which was sent via lines 6 and 8 and together with 12 pbw of a vacuum residue as defined hereinafter to catalytic residue conversion unit 30. During the conversion process 2.3 pbw of hydrogen were used.

The effluent from the catalytic residue conversion unit 30 was sent via line 9 to the distillation unit 40 which contains an atmospheric distillation stage and a vacuum distillation stage to produce 3.4 pbw of hydrogen sulphide and ammonia, 3.9 pbw of naphtha-minus, 5.0 pbw of naphtha, 11,8 pbw of kerosene, 16.3 pbw of gas oil (obtained via line 11), 18 pbw of a vacuum residue of which 12 pbw was recycled to catalytic residue conversion unit 30 via line 7 as described hereinbefore and 15.4 pbw of synthetic flashed distillate which was sent via lines 12 and 1 to catalytic hydrotreatment unit 10.

The combined flashed distillate and synthetic flashed distillate feedstock for the catalytic hydrotreatment unit 10 had the following properties: density (15/4): 0.93; hydrogen content: 12.1% wt; sulphur content: 2.3% wt; nitrogen content: 0.09% wt; Conradson Carbon Residue: <0.5% wt and mid boiling point of the feedstock: 445 ° C.

The material was subjected to a catalytic hydrotreatment in unit 10 under the conditions as described in Example I. 1.7 pbw of hydrogen were used during the treatment. The effluent from the catalytic hydrotreatment unit 10 was sent via line 2 to atmospheric distillation unit 20 to produce 1.4 pbw of hydrogen sulphide and ammonia, 2.8 pbw of naphtha-minus, 11.7 pbw of naphtha and 22.3 pbw of kerosene (via line 3) and 19.4 pbw of gas oil via line 4).

EXAMPLE IV - Conversion of synthetic flashed distillate (in recycle mode) and flashed distillate in separate hydrotreatment units The experiment as described in the previous example was repeated but now allowing the flashed distillate obtained after vacuum distillation of the starting material to be subjected to a catalytic hydrotreatment in a separate catalytic hydrotreatment unit (10B as depicted in FIG. 4). Thus, an atmospheric distillate of Middle East origin (100 pbw) was sent via line 25 to vacuum distillation unit 80 to produce 40.5 pbw of flashed distillate to be sent via lines 27 and 1B to catalytic hydrotreatment unit 10B and 59.5 pbw of vacuum residue which was sent via lines 6 and 8 and together with 12 pbw of a vacuum residue as defined hereinafter to catalytic residue conversion unit 30. During the conversion process 2.3 pbw of hydrogen were used.

The effluent from the catalytic residue conversion unit 30 was sent via line 9 to the distillation unit 40 which contains an atmospheric distillation stage and a vacuum distillation stage to produce 3.4 pbw of hydrogen sulphide and ammonia, 3.9 pbw of naphtha-minus, 5.0 pbw of naphtha, 11.8 pbw of kerosene, 16.3 pbw of gas oil (obtained via line 11), 18 pbw of a vacuum residue of which 12 pbw was recycled to catalytic residue conversion unit 30 via lines 13 and 7 as described hereinbefore and 15.4 pbw of synthetic flashed distillate which was sent via lines 12 and 1A to catalytic hydrotreatment unit 10A.

The properties of the synthetic flashed distillate to be converted in catalytic hydrotreatment unit 10A are: density (15/4): 0.93; hydrogen content: 11.9% wt; sulphur content: 0.7% wt; nitrogen content: 0.23% wt; Conradson Carbon Residue <0.5% wt and mid boiling point of the feedstock: 445 ° C. The properties of the flashed distillate to be converted in catalytic hydrotreater 10B are: density (15/4): 0.926; hydrogen content: 12.5% wt; sulphur content: 2.69% wt; nitrogen content: 0.05% wt; Conradson Carbon Residue: <0.5% wt and mid boiling point of the flashed distillate: 445 ° C.

The synthetic flashed distillate was subjected to a catalytic hydrotreatment in catalytic hydrotreatment unit 10A under the conditions as described in Example I. 0.5 pbw of hydrogen was used during the treatment. The effluent from the catalytic hydrotreatment unit 10A was sent via line 2A to atmospheric distillation unit 20A to product 0.2 pbw of hydrogen sulphide and ammonia, 0.8 pbw of naphtha-minus, 3.3 pbw of naphtha and 6.2 pbw of kerosene (via line 3A) and 5.4 pbw of gas oil (via line 4A).

The flashed distillate was subjected to a catalytic hydrotreatment in catalytic hydrotreatment unit 10B under similar conditions as prevailing in catalytic hydrotreatment unit 10A. 1.1 pbw of hydrogen was used during the treatment. The effluent from catalytic hydrotreatment unit 10B was sent via line 2B to atmospheric distillation unit 20B to produce 1.3 pbw of hydrogen sulphide and ammonia, 2.0 pbw of naphtha-minus, 8.4 pbw of naphtha and 15.9 pbw of kerosene (via line 3B) and 14.0 pbw of gas oil (via line 4B).

We claim:

1. A process for the manufacture of kerosene and/or gas oil, comprising the steps of:

producing a hydrocarbon feedstock to contain flashed distillate via a catalytic residue conversion process;

catalytically treating the hydrocarbon feedstock in the presence of hydrogen at elevated temperature and pressure; and subjecting the material obtained to a distillation treatment.

2. The process according to claim 1, wherein the feedstock used contains 10 to 60% by volume of flashed distillate.

3. The process according to claim 1, wherein flashed distillate is used produced via a catalytic residue hydroconversion process wherein at least 10% w of the feedstock is converted to lower boiling material.

4. The process according to claim 3, wherein the catalytic residue conversion process is carried out at a temperature of from 300 ° C. to 500 ° C., a pressure of from 50 to 300 bar and a space velocity of from 0.02 to 10 $kg.kg^{-1}.h^{-1}$.

5. The process according to claim 3, wherein the catalytic residue conversion process is carried out in the presence of a catalyst containing at least one metal chosen from the group formed by nickel and cobalt and in addition at least one metal chose from the group formed by molybdenum and tungsten on a carrier.

6. The process according to any one of claims 1–5, wherein a feedstock is used containing also flashed distillate obtained via vacuum distillation of an atmospheric residue.

7. The process according to any one of claims 1–5, wherein the catalytic treatment of the hydrocarbon feedstock comprises a catalytic cracking in the presence of hydrogen.

8. The process according to claim 1, wherein a feedstock containing flashed distillate produced via a catalytic residue conversion process is catalytically treated in parallel with a feedstock containing a flashed distillate obtained via vacuum distillation of an atmospheric residue.

9. The process according to any one of claims 1–5, wherein at least part of the gas oil produced is subjected to a dewaxing treatment.

10. The process according to claim 9, wherein use is made of a catalytic dewaxing treatment.

11. The process according to claim 9, wherein part or all of the material obtained via the dewaxing treatment is subjected to hydrotreatment.

12. The process according to any one of claims 1–5, wherein at least part of the bottom fraction of the distillation unit is recycled to the catalytic treatment unit.

13. The process according to claim 12, wherein part of the gas oil produced is recycled to the catalytic treatment unit.

14. The process according to claim 13, wherein by distillation a light and a heavy gas oil are produced and wherein at least part of the heavy gas oil is recycled to the catalytic treatment unit.

15. The process according to claim 12, wherein at least part of the bottom fraction of the distillation unit is used as ethylene cracker feedback.

16. The process according to any one of the claims 1–5, wherein an atmospheric residue is subjected to distillation under reduced pressure to produce a flashed distillate and a vacuum residue to be used as feedback for the catalytic residue conversion process.

17. The process according to any one of the claims 1–5 wherein a crude oil is subjected to an atmospheric distillation to produce one or more atmospheric distillates suitable for the production of kerosene and/or gas oil (s) and an atmospheric residue which is subjected to distillation under reduced pressure to produce flashed distillate which may be subjected to a catalytic (cracking) treatment in the presence of hydrogen and a vacuum residue which is used at least partly as feedstock in a catalytic residue conversion process to produce, if desired, one or more gas oils and a flashed distillate to be subjected to a catalytic (cracking) treatment in the presence of hydrogen whilst part or all of the bottom fraction may be recycled to the residue conversion unit and wherein catalytically treated material is subjected to a distillation treatment to obtain kerosene and one or more gas oils.

18. The process according to claim 17, wherein at least part of the gas oil obtained is subjected to a dewaxing treatment.

19. The process according to claim 18, wherein by distillation a light and a heavy gas oil are produced and wherein at least part of the heavy gas oil is subjected to catalytic dewaxing.

20. The process according to claim 17, wherein part of the gas oil produced is recycled to the catalytic treatment unit.

21. The process according to claim 17, wherein flashed distillate obtained by distillation under reduced pressure and flashed distillate obtained via a catalytic residue conversion process are catalytically cracked in the presence of hydrogen in the same reactor.

22. The process according to claim 17, wherein flashed distillate obtained by distillation under reduced pressure, and flashed distillate obtained by catalytic residue conversion are catalytically cracked in the presence of hydrogen in parallel reactors which may operate under different conditions and wherein the effluents obtained are subjected to separate distillation treatments.

23. The process according to claim 22, wherein part of the gas oils obtained in the separate distillation treatments are subjected to catalytic dewaxing and hydrotreatments in the same or different dewaxing and hydrotreating units.

24. The process according to claim 2, wherein flashed distillate is used produced via a catalytic residue hydroconversion process wherein at least 10% w of the feedstock is converted to lower boiling material.

25. The process according to claim 4, wherein the catalytic residue conversion process is carried out in the presence of a catalyst containing at least one metal chosen from the group formed by nickel and cobalt and in addition at least one metal chosen from the group formed by molyldenum and tungsten on a carrier.

26. The process according to claim 6, wherein the catalytic treatment of the hydrocarbon feedstock comprises a catalytic cracking in the presence of hydrogen.

27. The process according to claim 10, wherein part or all of the material obtained via the dewaxing treatment is subject to hydrotreatment.

* * * * *